US007498112B2

(12) United States Patent
Sweeney

(10) Patent No.: US 7,498,112 B2
(45) Date of Patent: Mar. 3, 2009

(54) EMULSION/AGGREGATION TONERS HAVING NOVEL DYE COMPLEXES

(75) Inventor: Maura A Sweeney, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 252 days.

(21) Appl. No.: 11/311,305

(22) Filed: Dec. 20, 2005

(65) Prior Publication Data

US 2007/0141495 A1 Jun. 21, 2007

(51) Int. Cl.
*G03G 9/08* (2006.01)

(52) U.S. Cl. ..... 430/108.2; 430/108.1; 430/109.3; 430/109.4; 430/137.14

(58) Field of Classification Search ..... 430/108.1, 430/108.2, 109.3, 109.4, 137.14
See application file for complete search history.

(56) References Cited

U.S. PATENT DOCUMENTS

| | | | | |
|---|---|---|---|---|
| 3,590,000 | A | | 6/1971 | Palermiti et al. |
| 3,655,374 | A | | 4/1972 | Palermiti et al. |
| 3,720,617 | A | | 3/1973 | Chatterji et al. |
| 3,944,493 | A | | 3/1976 | Jadwin et al. |
| 3,983,045 | A | | 9/1976 | Jugle et al. |
| 4,007,293 | A | | 2/1977 | Mincer et al. |
| 4,079,014 | A | | 3/1978 | Burness et al. |
| 4,288,586 | A | | 9/1981 | Bock et al. |
| 4,394,430 | A | | 7/1983 | Jadwin et al. |
| 4,560,635 | A | | 12/1985 | Hoffend et al. |
| 4,576,649 | A | | 3/1986 | Oliver et al. |
| 4,623,606 | A | * | 11/1986 | Ciccarelli ..... 430/108.21 |
| 4,664,715 | A | | 5/1987 | Jesse |
| 4,705,567 | A | * | 11/1987 | Hair et al. ..... 106/31.43 |
| 4,785,088 | A | | 11/1988 | Flohr et al. |
| 4,851,549 | A | | 7/1989 | Flohr et al. |
| 4,937,338 | A | | 6/1990 | Flohr et al. |
| 5,278,020 | A | | 1/1994 | Grushkin et al. |
| 5,290,654 | A | | 3/1994 | Sacripante et al. |
| 5,308,734 | A | | 5/1994 | Sacripante et al. |
| 5,344,738 | A | | 9/1994 | Kmiecik-Lawrynowicz et al. |
| 5,346,797 | A | | 9/1994 | Kmiecik-Lawrynowicz et al. |
| 5,364,729 | A | | 11/1994 | Kmiecik-Lawrynowicz et al. |
| 5,370,963 | A | * | 12/1994 | Patel et al. ..... 430/137.14 |
| 5,403,693 | A | | 4/1995 | Patel et al. |
| 5,418,108 | A | | 5/1995 | Kmiecik-Lawrynowicz et al. |
| 5,593,807 | A | | 1/1997 | Sacripante et al. |
| 6,142,618 | A | | 11/2000 | Smith et al. |
| 6,270,214 | B1 | | 8/2001 | Smith et al. |
| 6,387,581 | B1 | | 5/2002 | Moffat et al. |
| 6,395,445 | B1 | | 5/2002 | Toth et al. |
| 6,544,321 | B1 | | 4/2003 | Sweeney et al. |

FOREIGN PATENT DOCUMENTS

| | | |
|---|---|---|
| DE | 2806731 | 8/1979 |
| JP | 57-135863 | 8/1982 |

OTHER PUBLICATIONS

Pope et al., "Polyoxometalate Chemistry: An Old Field With New Dimensions in Several Disciplines," Angew. Chem. Int. Ed. Engl., vol. 30, pp. 34-48 (1991).

Shaffer et al., "Solid Polyethylene Glycols (Carbowax Compound) Quantitative Determination in Biological Materials," Analytical Chemistry, vol. 19, No. 1, pp. 32-34 (1947).

Stainer et al., "Stoichiometry of Formation and Conductivity Response of Amorphous and Crystalline Complexes Formed Between Poly(ethylene oxide) and Ammonium Salts: $PEO_x$-$NH_4SCN$ and $PEO_x$-$NH_4SO_3CF_3$," J. Electrochem. Soc., Science Techn., vol. 131, No. 4, pp. 784-790 (1984).

* cited by examiner

*Primary Examiner*—Mark F Huff
*Assistant Examiner*—Rachel L. Burney
(74) *Attorney, Agent, or Firm*—Oliff & Berridge, PLC

(57) ABSTRACT

Disclosed is a toner particle having at least binder and colorant. The colorant is a dye complex comprising a dye, a nonionic surfactant and a complexing agent. The toner having this colorant exhibits improved color gamut.

18 Claims, No Drawings

EMULSION/AGGREGATION TONERS HAVING NOVEL DYE COMPLEXES

TECHNICAL FIELD

This disclosure is directed to emulsion/aggregation toners having a novel dye complex comprising a dye, a nonionic surfactant and a complexing agent. The toners having the disclosed dye complex do not need any additional surfactant (s) as all of the components of the dye complex are reacted. In addition, the toner particles having the dye complex exhibit an improved color gamut.

BACKGROUND

U.S. Pat. No. 4,705,567 discloses a heterophase ink composition comprising water and a dye covalently attached to a component selected from the group consisting of poly(ethylene glycols) and poly(ethylene imines), which component is complexed with a heteropolyanion.

U.S. Pat. No. 4,664,715 discloses lakes based on basic dyes and heteropolyacids (PM, PTM, SM, PSTM and STM) and that are prepared by a process in which the lakes are heated to 50-100° C. at pH 2-5 in the presence of (1) primary, secondary or tertiary aliphatic amines, (2) alkylamino-$C_2$-$C_8$-alkanoic acids, (3) diaryl- or triarylamines, (4) acidic or neutral phosphates based on fatty alcohols, their ethylene oxide or propylene oxide/ethylene oxide adducts, polypropylene glycol, polyethylene glycol, or propylene oxide/ethylene oxide block copolymers, (5) sulfuric acid half esters of fatty alcohols, of their ethylene oxide adducts or alkylphenol/ethylene oxide adducts, (6) $C_8$-$C_{20}$-alkanoic acids and alkenoic acids, alkylbenzenesulfonic acids, alkylnaphthalenesulfonic acids or dialkylsulfimides, (7) alkylphenol/ethylene oxide adducts, alkanol/ethylene oxide adducts or alkylamine/ethylene oxide adducts, (8) propylene glycols or propylene oxide/ethylene oxide block copolymers of alkanediols or -polyols or (9) naphthols or alkylphenols.

U.S. Pat. No. 4,576,649 discloses the preparation of permanent pigments from selected cationic dyes by precipitation from aqueous solution with complex heteropoly acids in the presence of selected amine color enhancing agents.

U.S. Pat. No. 6,142,618 discloses a fluid deposition apparatus comprising (a) a fluid supply, (b) a porous fluid distribution member in operative connection with the fluid supply, enabling wetting of the fluid distribution member with a fluid, and (c) a porous metering membrane situated on the fluid distribution member, whereby the metering membrane enables uniform metering of the fluid from the fluid distribution member onto a substrate.

U.S. Pat. No. 6,270,214 discloses a process which comprises (a) applying to a substrate a fixing fluid which comprises a material selected from the group consisting of (1) block or graft copolymers of dialkylsiloxanes and polar, hydrophilic monomers capable of interacting with an ink colorant to cause the colorant to become complexed, laked, or mordanted, (2) organopolysiloxane copolymers having functional side groups capable of interacting with an ink colorant to cause the colorant to become complexed, laked, or mordanted, (3) perfluorinated polyalkoxy polymers, (4) perfluoroalkyl surfactants having thereon at least one group capable of interacting with an ink colorant to cause the colorant to become complexed, laked, or mordanted, and (5) mixtures thereof; (b) incorporating into an ink jet printing apparatus an ink composition which comprises water and a colorant which becomes complexed, laked, or mordanted upon contacting the fixing fluid; and (c) causing droplets of the ink composition to be ejected in an imagewise pattern onto the substrate.

U.S. Pat. No. 6,544,321 discloses pigment particles prepared by a process which comprises (a) preparing a solution of a polyalkylene oxide compound in water; (b) preparing a solution of a cationic dye in water; (c) admixing the solution containing the polyalkylene oxide compound with the solution containing the cationic dye to form a mixture; (d) adding to the mixture a solution containing a heteropolyacid in water, an alcohol, or a mixture thereof, thereby resulting in formation of pigment particles having an average particle diameter of no more than about 300 nanometers; and (e) after addition of the heteropolyacid to the mixture, neutralizing the mixture by addition of a base.

SUMMARY

In embodiments, disclosed is an emulsion/aggregation toner particle comprising at least binder and colorant, wherein the colorant includes a dye complex comprising a dye, a nonionic surfactant and a complexing agent.

In further embodiments, disclosed is a process of making the emulsion/aggregation toner, comprising mixing a resin, a colorant, and a coagulating agent to form particles, growing the particles to a desired size, halting the growth of the particles, and coalescing the particles until a suitable shape and morphology is obtained. The colorant comprises a dye complex of a dye, a nonionic surfactant and a complexing agent.

In yet further embodiments, disclosed herein is a xerographic device for forming images comprising the toner particle comprising at least binder and colorant, wherein the colorant includes a dye complex comprising a dye, a nonionic surfactant and a complexing agent.

EMBODIMENTS

A shortfall of pigment-based toners, and specifically polymer-based styrene/butylacrylate and polyester emulsion/aggregation toners is that the toners may not be able to produce the same wide color space/gamut as dye based systems that are used in lithographic and inkjet systems. This shortfall has limited pigment-based formulations in reaching wide spaces in the color gamut.

Disclosed herein are self-dispersing pigments comprised of a dye complex. The dye complex may be prepared by a self-assembly process. This process leverages the coacervative interaction of complexing agents with nonionic surfactants and basic dyes. When the dye and nonionic surfactant are covalently combined and a known molar amount of complexing agent is added, a self-dispersing pigment is created. These pigment dispersions may have excellent color quality and permanence.

Emulsion/aggregation (EA) toner particles containing the dye complex as a colorant may be employed in electrophotographic printing, lithography, facsimile machines, and the like. Key attributes include excellent pigment dispersion, print resolution, and enhanced color gamut.

The EA toner particles include at least a binder resin and a colorant. In embodiments, the binder may be a polyester resin or a styrene/acrylate resin. The colorant includes nonionic surfactant covalently bonded to a dye, forming a compound. The formed dye-nonionic surfactant compound is reacted with a complexing agent to form the dye complex. The dye complexes include at least a nonionic surfactant, a dye and a complexing agent.

The dye complexes herein may be characterized as nanoscale, self-stabilized pigments. Nanoscale refers to, for example, an average size (diameter) of about 200 nm or less, such as from about 0.1 nm to about 150 nm or about 1 nm to about 100 nm.

The nonionic surfactant may be a poly(ethylene glycol), a poly(ethylene imine), or the like. The nonionic surfactant may be an ethoxylated alkylphenol. Ethoxylated alkylphenols are commercially available from a number of vendors under trade names, TRITON®, TERGITOL®, and IGEPAL®. A generic structure of a commercially available ethoxylated alkylphenol is depicted below. The term "alkyl" refers to an alkyl chain that may be linear or branched, having from Ito 25 carbon atoms, such as from 1 to about 15 carbon atoms or from 1 to about 8 carbon atoms.

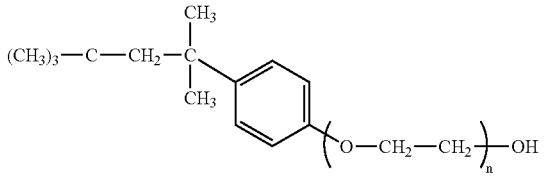

In embodiments, the n in the ethoxylated alkylphenol is from about 1 to about 60, such as from about 5 to about 45 or from about 6 to about 30. The higher molecular weight ethoxylated alkylphenols, with ethylene oxide units present in amounts of from about 10 to about 30, may exhibit better stabilization.

Covalently bound dye-nonionic surfactant compounds may be prepared by following in part known procedures, such as those described in German Pat. No. 28 0673 (1979) to Bayer or Japanese Publication No. 57-135863 (1982) to Nippon Kagaku, the disclosures of which are totally incorporated herein by reference. This preparation involves the reaction of a monofunctionalized methoxy poly(ethylene glycol) $CH_3$—O—($CH_2$ $CH_2$—O)$_n$—$CH_2$ $CH_2$—X, where n is an integer from about 1 to about 120, such as from about 3 to about 90 or from about 6 to about 60, and X is a leaving group such as chloride, bromide, tosylate, mesylate, and the like, with the dye.

A dye is covalently bonded to the nonionic surfactant. In embodiments, the dye is a basic dye, for example such as Basic Yellow 51, Rhodamine 6G, Victoria Blue B, combinations thereof and the like. These dyes are illustrated below.

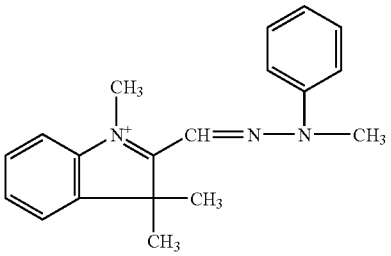

Basic Yellow 51

-continued

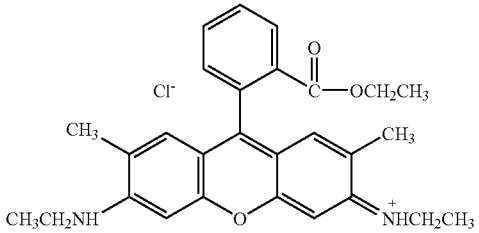

Rhodamine 6G

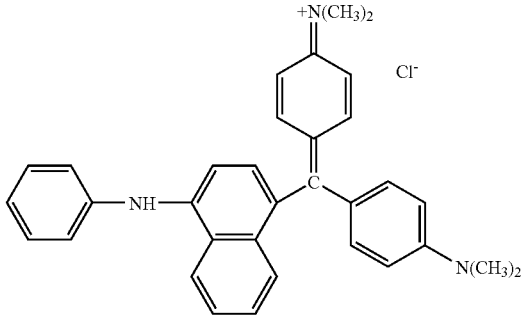

Victoria Blue B

Additional examples of suitable dye components include azo, xanthene, methine, polymethine, and anthraquinone dyes. Illustrative examples of azo dyes include solvent yellow 2, solvent yellow 58, solvent red 19, solvent red 27, disperse yellow 60, disperse orange 5, disperse orange 30, disperse orange 138, disperse red 1, disperse red 13, disperse red 41, disperse red 58, disperse red 72, disperse red 73, disperse red 90, disperse red 156, disperse red 210, disperse black 4, disperse black 7, disperse blue 183, disperse blue 165, dispersal fast red R, SRA brilliant blue 4, and pigment red 100; and the like. Illustrative examples of xanthene dyes include basic red 1, basic red 8, solvent red 45, and the like. Examples of methine and polymethine dyes include disperse yellow 31, disperse yellow 61, disperse yellow 99, basic violet 7, basic violet 16, and the like. Specific examples of anthraquinone dyes are solvent red 52, solvent violet 13, solvent blue 36, solvent blue 69, solvent green 3, pigment red 89, disperse red 4, disperse violet 6, disperse blue 3, disperse blue 6, disperse blue 23, disperse blue 28, disperse blue 34, disperse blue 60, disperse blue 73, reactive blue 6, and the like.

Suitable complexing agents include heteropolyacids such as phosphotungstic acid, phosphomolybdic acid, silicotungstic acid, dichromic acid, or their salts such as the sodium or potassium salts thereof, an mixtures thereof. Other known complexing agents for polyethylene oxide can be found in the literature, see for example M. Stainer, L. C. Hardy, D. H. Whitmore, and D. F. Shriver, J. Electrochem Soc., Electrochem, Science Techn., 131 (4) 784-790 (1984); C. B. Shaffer and F. H. Critchfield, Analyt. Chem., 19(10) 32-34 (1947); and include sodium tetraphenylborate, cobalt thiocyanate, potassium tetraiodo bismuthate (III), and the like.

Heteropolyacids, also known as polyoxometalates, are acids comprising inorganic metal-oxygen clusters. These materials are discussed in, for example, "Polyoxometalate Chemistry: An Old Field with New Dimensions in Several Disciplines," M. T. Pope et al., Angew. Chem. Int. Ed. Engl., Vol. 30, p. 34 (1991), the disclosure of which is totally incorporated herein by reference. Examples of suitable heteropolyacids include phosphotungstic acid, of the general formula $$H_3PO_4.12\ WO_3.XH_2O$$

(wherein x is variable, with common values including 12, 24, or the like), silicotungstic acid, of the general formula $$H_4SiO_4.12\ WO_3.XH_2O$$

(wherein X is variable, with common values including 12, 24, 26, or the like), phosphomolybdic acid, of the general formula $$12\ MoO_3.H_3PO_4.XH_2O$$

(wherein X is variable, with common values including 12, 24, 26, or the like) and the like, all commercially available from, for example, Aldrich Chemical Co., Milwaukee, Wis., as well as salts thereof and mixtures thereof.

In embodiments, the dye complex disclosed herein may contain from about 5 to about 30 percent by weight of complexing agent, such as from about 5 to about 25 percent or from about 5 to about 20 percent by weight of complexing agent, from about 5 to about 35 percent by weight of nonionic surfactant, such as from about 10 to about 30 percent or from about 10 to about 25 percent by weight of nonionic surfactant, and from about 5 to about 35 percent by weight of dye, such as from about 10 to about 30 percent or from about 10 to about 25 percent by weight of dye, and from about 50 to about 90 percent of weight of water, such as from about 60 percent to about 85 percent or from about 60 to about 80 percent by weight of water.

The dye complex may be made by a variety of different methods. In embodiments, the covalently bound dye-nonionic surfactant may be made by the method disclosed in U.S. Pat. No. 4,705,567, which is incorporated herein in its entirety by reference.

Once the covalently bound dye-nonionic surfactant is synthesized, it may be subjected to further processing, for example such as being dispersed, filtered and/or redried, to yield the dye-nonionic surfactant product. This product is then reacted with the complexing agent. The covalently bound dye-nonionic surfactant product ionically bonds to the complexing agent to the nonionic surfactant of the dye-nonionic surfactant product to generate the dye complex. In embodiments, the range of molar amounts of the complexing agent used to complex the dye-non-ionic surfactant may be from about 0.0001 M to about 0.01 M, such as from about 0.0005 M to about 0.01 M or from 0.001 M to about 0.005 M.

The generated dye complex is then incorporated into the EA toner process as the colorant for the toner. As the dye complex is self-dispersing, use of additional surfactant in the EA process is not necessary in generating the EA toner particles. Furthermore, there is no residual dye, nonionic surfactant or complexing agent found in the dye complex as all of the dye and nonionic surfactant have reacted to form a covalently bound product. In addition, the complexing agent is added in amounts to substantially completely react to form ionic bonds with the covalently bound dye-nonionic surfactant product. Thus, no residual components exist in the dye complex and a surfactant is not needed to absorb any existing residual components into the formed EA toner particles.

In embodiments, suitable binders for EA toner particles include polyester resin and styrene/acrylate resin.

Examples of suitable polyester resin binders include polyethylene-terephthalate, polypropylene-terephthalate, polybutylene-terephthalate, polypentylene-terephthalate, polyhexalene-terephthalate, polyheptadene-terephthalate, polyoctalene-terephthalate, polyethylene-sebacate, polypropylene sebacate, polybutylene-sebacate, polyethylene-adipate, polypropylene-adipate, polybutylene-adipate, polypentylene-adipate, polyhexalene-adipate, polyheptadene-adipate, polyoctalene-adipate, polyethylene-glutarate, polypropylene-glutarate, polybutylene-glutarate, polypentylene-glutarate, polyhexalene-glutarate, polyheptadene-glutarate, polyoctalene-glutarate polyethylene-pimelate, polypropylene-pimelate, polybutylene-pimelate, polypentylene-pimelate, polyhexalene-pimelate, polyheptadene-pimelate, poly(propoxylated bisphenol-fumarate), poly(propoxylated bisphenol-succinate), poly(propoxylated bisphenol-adipate) and poly(propoxylated bisphenol-glutarate).

A polyester toner, which is known in the art, is thus also suitable for use herein. Polyester toner particles, created by the EA process, are illustrated in a number of patents, such as U.S. Pat. No. 5,593,807, U.S. Pat. No. 5,290,654. U.S. Pat. No. 5,308,734, and U.S. Pat. No. 5,370,963, each of which is incorporated herein by reference in their entirety. Further examples of suitable polyester toner particles include those having sodio-sulfonated polyester resin as disclosed in a number of patents, such as U.S. Pat. Nos. 6,387,581 and 6,395,445, each of which is incorporated herein by reference in their entirety. The polyester may comprise any of the polyester materials described in the aforementioned references. As these references fully describe polyester EA toners and methods of making the same, further discussion on these points is omitted herein.

In polyester toner preparation, a resin emulsion is transferred into a glass resin kettle equipped with a thermal probe and mechanical stirrer. A pigment is added into this reactor while stirring. Additionally, a wax dispersion may optionally be added for oil-less systems. The pigmented mixture is stirred and heated using an external water bath to a desired temperature, for example from about 40° C. to about 70° C., such as from about 45° C. to about 70° C. or from about 40° C. to about 65° C., at a rate from about 0.25° C./min. to about 2° C./min., such as from about 0.5° C./min. to about 2° C./min. or from about 0.25° C./min. to about 1.5° C./min. A freshly prepared solution of a coalescing agent is made to ensure efficacy of the aggregation. Once the emulsion reaches the desired temperature, the solution of a coalescing agent is pumped into the mixture, for example through a peristaltic pump. The addition of the solution of coalescing agent is completed after, for example, from about 1 hour to about 5 hours, such as from about 1 hour to about 4 hours or from about 1.5 hours to about 5 hours, and the mixture is additionally stirred from about 1 hour to about 4 hours, such as from about 1 hour to about 3.5 hours or from about 1.5 hours to about 4 hours. The temperature of the reactor may then be raised towards the end of the reaction to, for example, from about 45° C. to about 75° C., such as from about 50° C. to about 75° C. or from about 45° C. to about 70° C., to ensure spheridization and complete coalescence. The mixture is then quenched with deionized water that is at a temperature of, for example, from about 29° C. to about 45° C., such as from about 32° C. to about 45° C. or from about 29° C. to about 41° C. The slurry is then washed and dried.

Examples of styrene/acrylate resin binders include poly (styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly(styrene-alkyl methacrylate-acrylic acid), poly(alkyl methacrylate-alkyl acrylate), poly(alkyl methacrylate-aryl acrylate), poly (aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), and poly(alkyl acrylate-acrylonitrile-acrylic acid); the latex contains a resin selected from the group consisting of poly(styrene-butadiene), poly(methylstyrene-butadiene), poly(methyl methacrylate-butadiene), poly(ethyl methacrylate-butadiene), poly(propyl methacrylate-butadiene), poly (butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); poly(styrene-propyl acrylate), poly (styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), and poly(styrene-butyl acrylate-acrylononitrile-acrylic acid).

Styrene/acrylate toner particles created by the EA process are illustrated in a number of patents, such as U.S. Pat. Nos. 5,278,020, 5,346,797, 5,344,738, 5,403,693, 5,418,108, and 5,364,729, each of which is incorporated herein by reference in their entirety. The styrene/acrylate may comprise any of the materials described in the aforementioned references. In embodiments, the styrene/acrylate, such as styrene/butyl acrylate toner particles may include β-carboxyethylacrylate. β-carboxyethylacrylate may be present in the emulsion in a range from about 1 weight percent to about 10 weight percent, such as from about 2 weight percent to about 10 weight percent or from about 1 weight percent to about 8 weight percent, styrene may be present in the emulsion in a range from about 65 to about 85 weight percent, such as in a range from about 70 to about 85 weight percent or from about 65 to about 80 weight percent, and acrylate, for example butyl acrylate, may be present in the emulsion in a range from about 15 to about 35 weight percent, such as from about 20 to about 35 weight percent or from about 15 to about 30 weight percent.

EA toner formulations using a styrene/acrylate resin may be made by first homogenizing then mixing resin, a dye complex, and a coagulating agent at a temperature at or above the Tg of the resin, such as 5° C. to about 50° C. above the Tg of the resin, which Tg is usually in the range of from about 50° C. to about 80° C. or is in the range of from about 52° C. to about 65° C. The mixture is grown to a desired size, such as from about 3 to about 20 microns, for example from about 4 to about 15 microns or from about 5 to about 10 microns. An outer shell, for example consisting essentially of binder resin, may then be added, for example having a thickness of about 0.1 to about 2 micron, and then growth is halted with the addition of a base. The particles are then coalesced at an elevated temperature, such as from about 60° C. to about 98° C., until a suitable shape and morphology is obtained. Particles are then optionally subjected to further processing, for example, such wet sieved, washed by filtration, and/or dried. The slurry may then be washed to remove impurities. The washing involves base addition, addition of an optional enzyme product and mixing for several hours. The toner particles are then filtered to a wet cake, reslurried with deionized water and mixed. After mixing, the slurry is dewatered, added to deionized water, pH adjusted and mixed. The pH is adjusted to be from about 3 to about 5, such as from about 3.5 to about 5 or from about 3 to about 4.5. The particles are then dewatered again and reslurried with a smaller amount of water to better disperse during the drying process. The parent toner particles are then dried using a drier and packaged. This is merely one example of an EA process, other processes include the production of polyester EA toner which may be made in a different manner.

The resin is present in various effective amounts, such as from about 85 weight percent to about 98 weight percent of the toner, and can be of small average particle size, such as from about 0.01 micron to about 1 micron in average volume diameter as measured by the Brookhaven nanosize particle analyzer.

In embodiments, in addition to the dye complex disclosed herein, the toner particles may include other components such as waxes, curing agents, charge additives, and surface additives.

Examples of waxes include functionalized waxes, polypropylenes and polyethylenes commercially available from Allied Chemical and Petrolite Corporation, wax emulsions available from Michaelman Inc. and the Daniels Products Company, EPOLENE N-15 commercially available from Eastman Chemical Products, Inc., VISCOL 550-P, a low weight average molecular weight polypropylene available from Sanyo Kasei K. K., and similar materials. Commercially available polyethylenes usually possess a molecular weight of from about 1,000 to about 1,500, while the commercially available polypropylenes are believed to have a molecular weight of from about 4,000 to about 5,000. Examples functionalized waxes include amines, amides, imides, esters, quaternary amines, carboxylic acids or acrylic polymer emulsion, for example JONCRYL 74, 89, 130, 537, and 538, all available from SC Johnson Wax, and chlorinated polypropylenes and polyethylenes commercially available from Allied Chemical and Petrolite Corporation and SC Johnson wax. When utilized, the wax may be present in the dye complex in an amount from about 2 weight % to about 20 weight %, such as from about 3 weight % to about 15 weight % or from about 4 weight % to about 12 weight %, of the toner.

The toner may also include known charge additives in effective amounts of, for example, from 0.1 to 5 weight percent, such as alkyl pyridinium halides, bisulfates, the charge control additives of U.S. Pat. Nos. 3,944,493, 4,007,293, 4,079,014, 4,394,430 and 4,560,635, which illustrates a toner with a distearyl dimethyl ammonium methyl sulfate charge additive, the disclosures of which are totally incorporated herein by reference, negative charge enhancing additives like aluminum complexes, and the like.

Surface additives that can be added to the toner compositions after washing or drying include, for example, metal salts, metal salts of fatty acids, colloidal silicas, metal oxides like titanium, tin and the like, mixtures thereof and the like, which additives are usually present in an amount of from about 0.1 to about 2 weight percent, reference U.S. Pat. Nos. 3,590,000, 3,720,617, 3,655,374 and 3,983,045, the disclosures of which are totally incorporated herein by reference. Additives include, for example, titania and flow aids, such as fumed silicas like AEROSIL R972® available from Degussa Chemicals, or silicas available from Cabot Corporation or Degussa Chemicals, each in amounts of from about 0.1 to about 2 percent, which can be added during the aggregation process or blended into the formed toner product.

EXAMPLE

A toner is made using a standard EA process. A Victoria Blue B dye is covalently attached to an ethoxylated alkylphenol with a molecular weight of 605 g/mol and a hydrophilic lipophilic balace (HLB) value of 13.5. This dye complex is made as described in U.S. Pat. No. 4,705,567, incorporated herein in its entirety by reference. To this dye/ethoxylated alkylphenol is added a specific molar amount of heteropolyacid, such as phosphotungstic acid. The mixture is then mixed, centrifuged and redispersed to obtain small cyan particles. The particles are redispersed and added to a latex resin such as a styrene/butylacrylate. Additionally, a wax may be added for an oil-less fusing system. The mixture is then homogenized at high shear with a coagulating agent such as polyaluminum chloride for twenty minutes. The mixture is then aggregated for a period of time until the particle size is sufficient for latex shell addition (such as from about 4.0 to about 6.0 μm). A latex shell is added until completion, and then the particle is grown further until the optimum particle size is reached. The aggregation is then stopped by the addition of a base, such as sodium hydroxide or ammonium hydroxide. After a period of time, the batch is heated to the coalescing temperature of from about 85° C. to about 100° C. and kept at that elevated temperature for a period from about 1 hour to about 8 hours depending upon the desired shape. The particle batch is then cooled to a lower temperature, and pH is adjusted with a base. The particle batch is then sieved and washed several times with deionized water, then washed with an acid adjusted rinse before a final rinse with deionized water. The batch is dried and blended with a select set of additives for machine testing.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. An emulsion/aggregation toner particle comprising at least binder and colorant;

wherein the colorant includes a dye complex having an average size of less than about 200 nm;

wherein the dye complex comprises a dye, a nonionic surfactant and a complexing agent, wherein the is covalently attached to the nonionic surfactant, and the nonionic surfactant is complexed with complexing agent; and wherein the nonionic surfactant is ethoxylated alkylphenol having a formula of

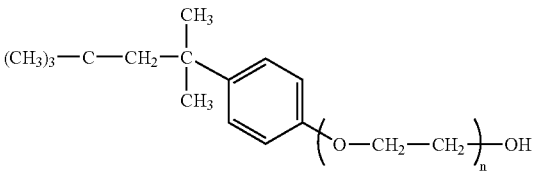

wherein n is an integer from about 1 to about 60.

2. The toner particle according to claim 1, wherein the binder is a polyester resin or a styrene/acrylate resin.

3. The toner particle according to claim 2, wherein the polyester resin is selected from the group consisting of polyethylene-terephthalate, polypropylene-terephthalate, polybutylene-terephthalate, polypentylene-terephthalate, polyhexalene-terephthalate, polyheptadene-terephthalate, polyoctalene-terephthalate, polyethylene-sebacate, polypropylene sebacate, polybutylene-sebacate, polyethylene-adipate, polypropylene-adipate, polybutylene-adipate, polypentylene-adipate, polyhexalene-adipate, polyheptadene-adipate, polyoctalene-adipate, polyethylene-glutarate, polypropylene-glutarate, polybutylene-glutarate, polypentylene-glutarate, polyhexalene-glutarate, polyheptadene-glutarate, polyoctalene-glutarate polyethylene-pimelate, polypropylene-pimelate, polybutylene-pimelate, polypentylene-pimelate, polyhexalene-pimelate, polyhexalene-pimelate, poly(propoxylated bisphenol-fumarate), poly(propoxylated bisphenol-succinate),poly(propoxylated bisphenol-adipate) and poly)propoxylated bisphenol-glutarate).

4. The toner particle according to claim 2, wherein the styrene/acrylate resin is selected from the group consisting of poly(styrene-alkyl acrylate), poly(styrene-1,3-diene), poly (styrene-alkyl methacrylate), poly(styrene-alkyl acrylate-acrylic acid), poly(styrene-1,3-diene-acrylic acid), poly(styrene-alkyl methacrylate-acrylic acid), poly(alkyl methacrylate-alkyl acrylate), poly(alkyl methacrylate-aryl acrylate),poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid),and poly(alkyl acrylate-acrylonitrile-acrylic acid), poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate- isoprene), poly(butyl acrylate-isoprene), poly(styrene-propyl acrylate), poly (styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylonitrile), poly (styrene-butyl acrylate-acrylonitrile-acrylic acid) and poly (styrene-butyl acrylate-β-carboxyehtylacrylate).

5. The toner particle according to claim 1, wherein the complexing agent is a heteropolyacid.

6. The toner particle according to claim 5, wherein the heteropolyacid is selected from the group consisting of phosphotungstic acid, phosphomolybdic acid, silicotungstic acid, dichromic acid, salts thereof, and mixtures thereof.

7. The toner particle according to claim 1, wherein the complexing agent is selected from the group consisting of sodium tetraphenylborate, cobalt thiocyanate, potassium tetraiodo bismuthate (III), and mixtures thereof.

8. The toner particle according to claim 1, wherein the dye is selected from the group consisting Basic Yellow 51, Rhodamine 6G, and Victoria Blue B.

9. The toner particle according to claim 1, wherein the dye is selected from the group consisting of solvent yellow 2, solvent yellow 58, solvent red 19 solvent red 19, solvent red 27, disperse yellow 60, disperse orange 5, disperse orange 30, disperse orange 138, disperse red 1, disperse red 13, disperse red 41, disperse red 58, disperse red 72, disperse red 73, disperse red 90, disperse red 156, disperse red 210, disperse black 4, disperse black 7, disperse blue 183, disperse blue 165, dispersol fast red R, SRA brilliant blue 4, and pigment red 100, basic red 1, basic red 8, solvent red 45, disperse yellow 31, disperse yellow 61, disperse yellow 99, basic violet 7, basic violet 16, solvent red 52, solvent violet 13, solvent blue 36, solvent blue 69, solvent green 3, pigment red 89, disperse red 4, disperse violet 6, disperse blue 3, disperse blue 6, disperse blue 23, disperse blue 28, disperse blue 34, disperse blue 60, disperse blue 73 and reactive blue 6.

10. The toner particle according to claim 1, wherein the colorant contains from about 5 to about 30 percent by weight of a complexing agent, from about 5 to about 35 percent by weight of the nonionic surfactant and from about 5 to about 35 percent by weight of the dye, and from about 50 percent by weight to about 90 percent by weight of water.

11. The toner particle according to claim 1, wherein the toner particle further comprises waxes, curing agents, charge additives, and/or surface additives.

12. The toner particle according to claim 11, wherein the waxes are selected from the group consisting of functionalized waxes, polypropylenes and polyethylenes.

13. toner particle according to claim 11 wherein the charge additives are selected from the group consisting of alkyl pyridinium halides, bisulfates, distearyl dimethyl ammonium methyl sulfate and aluminum complexes.

14. The toner particle according to claim 11 wherein the surface additives are selected from the group consisting of metal salts, metal salts of fatty acids, metal oxides, titania and silicas.

15. A process for making an emulsion/aggregation toner particle, comprising:

mixing a resin, a colorant, and a coagulating agent;

aggregating particles to a size from about 3 to about 20 microns;

halting the aggregation of the particles; and coalescing the particles, wherein the colorant comprises a dye complex including a dye, a nonionic surfactant and a complexing agent; and wherein the nonionic surfactant is ethoxylated alkylphenol having a formula of

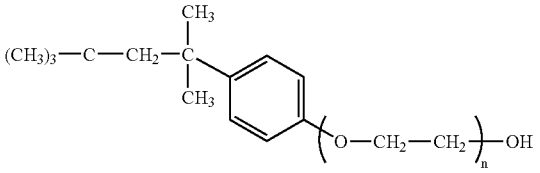

wherein n is an interger from about 1 to about 60.

16. The process according to claim 15, wherein the process further comprises:

covalently bonding the nonionic surfactant to the dye to form a compound; and reacting the formed dye-nonionic surfactant compound with the complexing agent to generate the dye complex.

17. The process according to claim 15 wherein the mixing occurs at a temperature from about 50° C. to about 80° C., growth of the toner particles are halted by addition of a base, and coalescing occurs at a temperature from about 60° C. to about 98° C.

18. The process according to claim 15, wherein the mixing occurs at a temperature from about 40° C. to about 70° C. and coalescing occurs at a temperature from about 45° C. to about 75° C. and by addition of a coalescing agent.

* * * * *